US006692030B1

(12) United States Patent
Phillips

(10) Patent No.: US 6,692,030 B1
(45) Date of Patent: Feb. 17, 2004

(54) SECURITY DOCUMENT WITH NANO-PATTERN

(75) Inventor: George K. Phillips, Paso Robles, CA (US)

(73) Assignee: Verify First Technologies, Inc., Paso Robles, CA (US)

( * ) Notice: Subject to any disclaimer, the term of this patent is extended or adjusted under 35 U.S.C. 154(b) by 0 days.

(21) Appl. No.: 09/621,325

(22) Filed: Jul. 21, 2000

(51) Int. Cl.[7] ..... B42D 15/00

(52) U.S. Cl. ..... 283/91; 283/72; 283/73; 283/74; 283/91; 283/93; 283/114; 428/195; 428/913; 428/915; 428/916; 430/10; 399/366; 382/100

(58) Field of Search ..... 283/91, 72, 73, 283/74, 114, 93; 428/195, 913, 915, 916; 430/10; 399/366; 382/100; 380/3, 51, 243

(56) References Cited

U.S. PATENT DOCUMENTS 4,168,088 A * 9/1979 Somlyody ..... 283/72
4,227,719 A * 10/1980 McElligott et al. ..... 283/58
4,310,180 A * 1/1982 Mowry, Jr. et al. ..... 283/72

(List continued on next page.)

FOREIGN PATENT DOCUMENTS

WO WO-97/31784 * 9/1997
WO WO-99/48700 * 9/1999

OTHER PUBLICATIONS

K.J. Schell, *Optical Document Security,* "The Historical Development of Security Printing: Design and Technology," pp. 131–199.

HCC's Double Take Page/Double Take, "A New Way to Look at Secure Documents," http://www.hcc–graphics.com/doubletake.htm.

*Primary Examiner*—A. L. Wellington
*Assistant Examiner*—Mark T. Henderson
(74) *Attorney, Agent, or Firm*—Michael J. Bolan; Bingham McCutchen LLP

(57) ABSTRACT

A counterfeit-resistant document comprises a substrate and a nano-pattern of nano-structures disposed on the substrate, wherein the nano-pattern is configured for forming a latent message (e.g., a warning or alert message) that appears on a copy of the document. The nano-pattern forms one of a foreground and a background of the latent message; and another pattern, e.g., a conventional pattern or another nano-pattern, forms the other of the foreground and background of the latent message. The nano-pattern and the other pattern are configured, such that the foreground and background exhibit substantially similar visual densities on an original of the document, and exhibit substantially different visual densities on the copied document. This can be accomplished by forming the nano-pattern with nano-structures (e.g., polygons, circles, ovals, crosses, x's, or alphanumerical characters), which are composed of plurality of adjacent rectilinear and/or curvilinear elements that are configured to trap printing matter, such as ink or toner, when electronically copied, thereby darkening the nano-pattern on the copied document. Trapping of the printing matter is facilitated by the design and miniature size of the adjacent elements that form the nano-structures (preferably, one and one-half point print size or less).

65 Claims, 10 Drawing Sheets

U.S. PATENT DOCUMENTS 4,552,617 A 11/1985 Crane ..... 162/103
5,018,767 A * 5/1991 Wicker ..... 283/72
5,171,040 A * 12/1992 Orndorff ..... 283/58
5,193,853 A * 3/1993 Wicker ..... 283/72
5,344,192 A 9/1994 Phillips ..... 283/91
5,375,886 A * 12/1994 Tsuchiya ..... 283/902
5,479,507 A * 12/1995 Anderson ..... 283/93
5,481,378 A * 1/1996 Sugano et al. ..... 358/501
5,568,248 A * 10/1996 Wagley ..... 399/156
5,695,220 A 12/1997 Phillips ..... 283/91
5,704,651 A 1/1998 Phillips ..... 283/93
5,762,378 A 6/1998 Phillips ..... 283/72
5,772,248 A 6/1998 Phillips ..... 285/91
5,795,643 A * 8/1998 Steininger et al. ..... 283/72
5,807,625 A * 9/1998 Amon et al. ..... 283/72
5,826,916 A 10/1998 Phillips ..... 283/91
5,843,564 A * 12/1998 Gasper et al. ..... 428/211
5,853,197 A * 12/1998 Mowry et al. ..... 283/93
5,873,604 A * 2/1999 Phillips ..... 283/70
5,924,737 A 7/1999 Schrupp ..... 283/58
5,951,055 A * 9/1999 Mowry, Jr. ..... 283/93
5,954,368 A * 9/1999 Mowry, Jr. ..... 283/93
6,000,728 A * 12/1999 Mowry, Jr. ..... 283/902
6,030,691 A 2/2000 Burchard et al. ..... 428/195
6,038,016 A 3/2000 Jung et al. ..... 356/71
6,062,604 A 5/2000 Taylor et al. ..... 283/72
6,095,425 A * 8/2000 Mowry, Jr. ..... 235/494
6,104,812 A * 8/2000 Koltai et al. ..... 380/51
6,301,363 B1 * 10/2001 Mowry, Jr. ..... 380/54
6,394,358 B1 * 5/2002 Thaxton et al. ..... 235/494
6,481,753 B2 * 11/2002 Van Boom et al. ..... 283/72
2002/0012447 A1 * 1/2002 Amidror et al. ..... 382/100
2002/0176114 A1 * 11/2002 Zeller et al. ..... 358/3.28

* cited by examiner

SECURITY DOCUMENT WITH NANO-PATTERN

FIELD OF THE INVENTION

The present inventions pertain to the field of documents, including more particularly to novel duplication resistant documents.

BACKGROUND

The importance of making documents safe from duplication and alteration is readily apparent. The advent of improved photocopy equipment, particularly high resolution digital color photocopy equipment, as well as desk top publishing and digital scanning, has provided the unscrupulous with the means for unauthorized duplication of original documents for the purpose of passing them off, with or without alteration, as the original document. The quality of the reproductions obtainable through these means is so good that it is difficult to distinguish original copies from color reproductions. Even if the duplication is not exact, the reproduction often appears authentic in the absence of the original for comparison. This problem is well-known to the issuers of such original documentation, and considerable attention has been given to find ways and means to prevent unauthorized duplication of such documents by photocopiers or other electronic methods.

Many techniques have been developed to prevent improper reproduction of original documents. One of the more known techniques is based on the phenomenon that photographic copiers have an element value (sometimes referred to as element frequency) threshold above which the photocopier is unable to distinguish the individual elements of the pattern of halftone printing. In general, a pattern with a low line screen value of large sized elements is more easily reproducible than a pattern with a high line screen value of small sized elements.

In accordance with this technique, a hidden warning message, such as "VOID" or "COPY," is printed in a halftone over a halftone background printed on a substrate. The line screen value of the hidden warning message is selected, such that the halftone elements of the hidden warning message are reproduced when photocopied. The line screen value of the background, however, is selected, such that the halftone elements of the background are not reproduced when photocopied. As a result, the hidden warning message will appear on duplicates of the original document made by photocopying. This method is also used by reversing the halftones of the hidden warning message and the background, such that the elements of the hidden warning message are not reproduced and the elements of the background are reproduced when photocopied or scanned.

In addition to selecting differing line screen values for the hidden warning message and the background pattern to allow them to be used to prevent duplication, it is also known to select differing tonal screen values (i.e., the percentage of ink coverage), so that the hidden warning message more easily appears on a reproduction of the original document.

Because of the disparity between the respective line screen values and respective tonal screen values of the hidden warning message and background pattern, a mere combination of these two techniques would not be effective, because the hidden warning message would normally be visible to a casual observer of the original. To minimize the visible appearance of the warning message with this combined technique, the respective tonal screen values are selected so that they are more similar, and/or a camouflage pattern can be printed over, or combined with, the hidden warning message and background to help obscure the hidden warning message from a casual observer of the original document. A description of these aforementioned techniques can be found in U.S. Pat. Nos. 4,227,720 and 5,197,795.

While the above techniques have provided some degree of protection of original documents with respect to most copiers, in recent years digital scanners and color copiers have improved substantially. These new color copiers, such as the Canon 800 and 1000 series, have made the above techniques less effective in protecting original documents. By manipulating the control settings on such devices, copies can be made of such original documents in which the hidden warning message does not readily appear on reproductions when some of the most commonly used frequency and element size combinations are used. When the contrast setting of these modern photocopiers is set to the lighter settings or the copier is set to a built-in halftone setting, the resolution of the copier is such that it reproduces neither the lower line screen value/high tonal screen value hidden warning message nor the higher line screen value/lower tonal screen value background pattern. If the line screen value and tonal screen value of the hidden warning message is adjusted so that the lower line screen value/high tonal screen value hidden warning message is reproduced at a lighter copier setting, both the higher line screen value/lower tonal screen value background pattern and the lower line screen value/higher tonal screen value hidden warning message are reproduced. In both cases, the hidden warning message does not readily appear on the reproduction of the original document, so that a casual observer of the document may not be alerted that the document in possession is not the original.

A greater disparity between the respective line screen values and tonal screen values of the hidden warning message and background pattern would allow the hidden warning message to appear on a reproduction of the original document even with the manipulation of the copier. Due to the great disparity, however, most presently known camouflage techniques do not adequately suppress the visual appearance of the hidden warning message on the original document. This could result in the original document being rejected as a copy, which would not be acceptable to issuers of the original.

Recently, a camouflaging technique has become available, whereby a dynamic camouflaging layer composed of an environmentally density changing ink, such as thermochromic ink, is used to camouflage a hidden warning message formed by a contrasting layer similar to those described above. In accordance with this technique, the density of the dynamic camouflaging layer, which is normally great enough to camouflage the hidden warning message, decreases when the original document is copied, thereby exhibiting the latent warning message on the copy. Thus, the dynamic nature of the camouflaging layer allows the disparity of the contrasting layer that makes up the hidden warning message to exhibit a greater disparity than otherwise allowed by a non-dynamic camouflaging layer. Details concerning the use of such dynamic camouflaging techniques are described in copending application Ser. No. 09/046,571, which is fully and expressly incorporated herein by reference.

Although the aforementioned dynamic camouflaging technique is generally successful in precluding an unscrupulous copyist from suppressing the hidden warning message on a reproduction of the original document, future developments in copier technology necessitate continued improvements in techniques used to prevent counterfeiting of original documents. These improved techniques can be either independent from, or combined with, dynamic camouflaging or other techniques.

SUMMARY OF THE INVENTION

The present invention comprises a document and method of producing, such a document that, when reproduced, exhibits a latent message.

In accordance with a first aspect of the present inventions, a document comprises a substrate and a nano-pattern disposed on the substrate, wherein the nano-pattern is configured for forming a latent message (e.g., a warning or alert message) that appears on a copy of the document. For example, the nano-pattern can form either the foreground or the background of the latent message, and be configured, such that the foreground or background exhibits a first visual density on the original document, and a second visual density greater than the first visual density on the copied document.

In the preferred embodiment, the nano-pattern forms one of a foreground and a background of the latent message; and another pattern, e.g., a conventional halftone or screened pattern or another nano-pattern, forms the other of the foreground and background of the latent message. The nano-pattern and the other pattern are configured, such that the foreground and background exhibit substantially similar visual densities on an original of the document, and exhibit substantially different visual densities on the copied document. This can be accomplished by forming the nano-pattern with a plurality of adjacent elements that are configured to trap printing matter, such as ink or toner, when electronically copied, thereby darkening the nano-pattern on the copied document. Trapping of the printing matter is facilitated by the design and miniature size of the adjacent elements, which are preferably less than two-point print, and most preferably, less than one and one-half point print or less. The plurality of adjacent elements that make up the nano-pattern can be combined into a series of nano-structures, e.g., polygons, circles or ovals, crosses or x's, or alpha-numerical characters, to produce the desired darkening effect. The series of nano-structures can either be uniformly sized and spaced, resulting in a regular nano-pattern, or variably sized and spaced, resulting in an irregular nano-pattern. Additionally, the variably sized and spaced nano-structures can be configured in a modulation pattern to form the variably sized and spaced nano-pattern.

In accordance with a second aspect of the present inventions, a document comprises a substrate and a latent message formed by a pattern that is configured for trapping printing matter, e.g., ink or toner, when electronically copied. For example, the pattern can be formed of a plurality of adjacent rectilinear elements and/or curvilinear elements that coordinate with each other to trap the printing matter. In this manner, the latent message is darkened, and thus activated, on a copy of the document.

In the preferred embodiment, the pattern forms one of a foreground and a background of the latent message, and another pattern forms the other of the foreground and background of the latent message. The two patterns are configured to respectively exhibit first and second visual densities on the original document, and respectively exhibit s third and fourth visual densities on the copied document, wherein the first and second visual densities are substantially similar, and the third and fourth visual densities are substantially different.

In accordance with a third aspect of the present inventions, a document comprises a substrate and a nano-pattern disposed on the substrate, wherein the nano-pattern is configured for forming a latent message (e.g., a warning or alert message) that appears on a copy of the document. The document further comprises a camouflage pattern disposed on the substrate, wherein the camouflage pattern coincides with the latent message. The camouflage pattern can be composed of a standard ink or environmentally changing ink, such as a thermochromic ink.

If a thermochromic ink is used for the camouflage pattern, it preferably exhibits a visual density that is inversely proportional to the ambient temperature. For example, the thermochromic ink can have a cold density, such that the camouflage pattern is inactivated at room temperatures, and a warm density, such that the camouflage pattern is activated at scanning temperatures. In this manner, when inactivated, the camouflage pattern suppresses the latent message on the original document, and when activated, exhibits the latent message on the copied document.

DETAILED DESCRIPTION OF THE PREFERRED EMBODIMENTS

Figure 1:
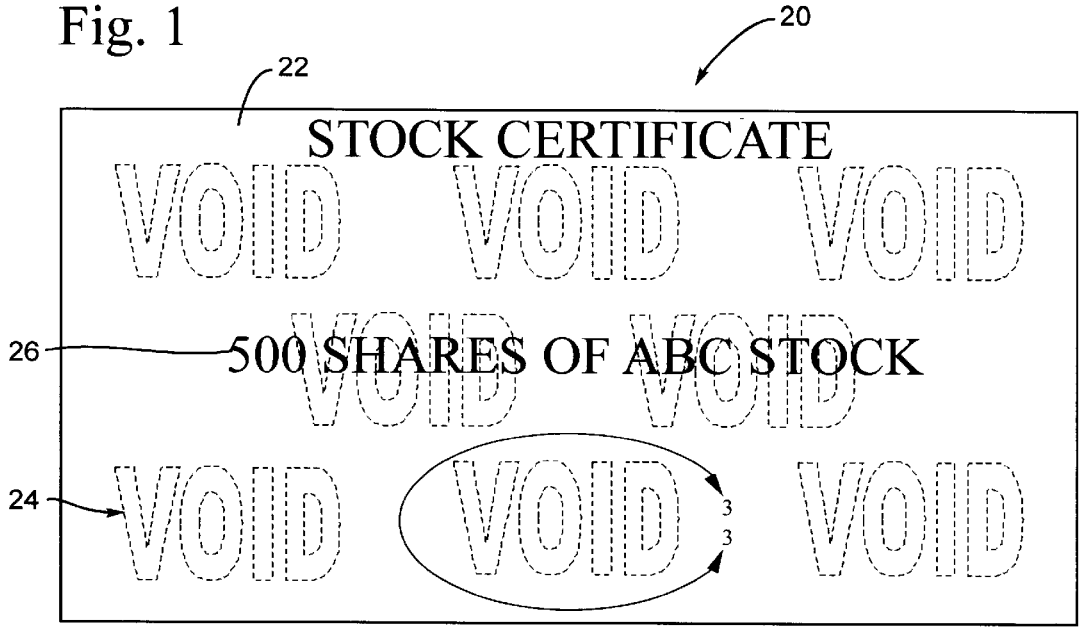
FIG. 1 is a top view of an original counterfeit-resistant document constructed in accordance with a preferred embodiment of the present inventions.
Figure 2:
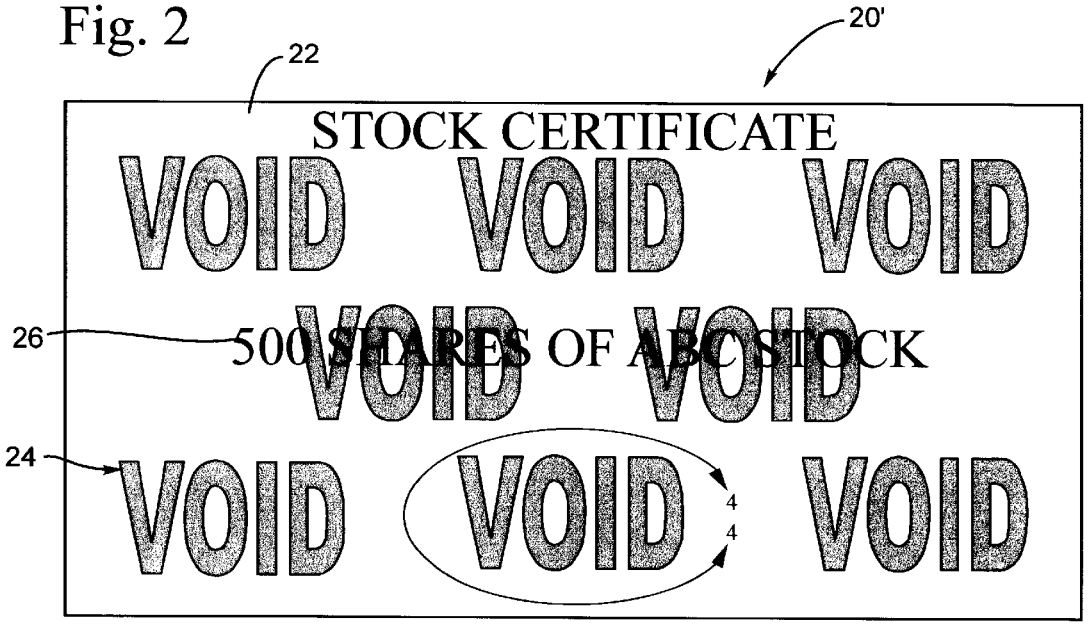
FIG. 2 is a top view of an electronic copy of the document of FIG. 1.

FIG. 1 depicts a counterfeit-resistant original document 20 (in this case, a stock certificate) comprising a substrate 22, a latent message 24, and bearer information 26. The substrate 22 is preferably of paper stock. Any material suitable for printing, however, may be used without departing from the scope of the present invention. As will be described in further detail below, the latent message 24 is not readily seen on the original document 20 by a casual observer, and is thus illustrated in phantom on the original document 20. When the original document 20 is copied using an electronic copier, however, the latent message 24 readily appears on the copied document 20', as shown in FIG. 2. In the illustrated embodiment, the latent message 24 forms the word "VOID," thereby alerting the observer that he or she is not in possession of the original document 20, but rather the copied document 20'. It is anticipated that the present invention will be particularly suitable for checks, stocks, bonds, and other documents of value, although the present invention is not limited to these applications, and can be used in any application in which it is desirable to be able to prevent or detect the unauthorized alteration, reproduction or duplication of an original document, such as labels, prescriptions, etc.

Figure 3:
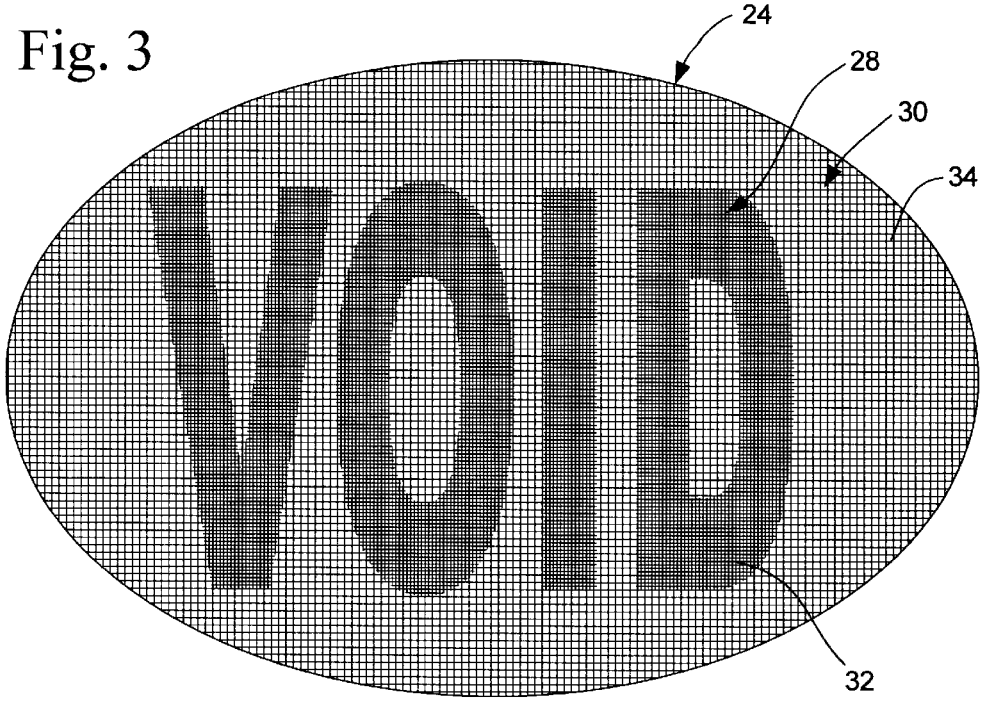
FIG. 3 is a top view of a preferred latent message appearing on the original document of FIG. 1, wherein the latent message is inactivated.
Figure 4:
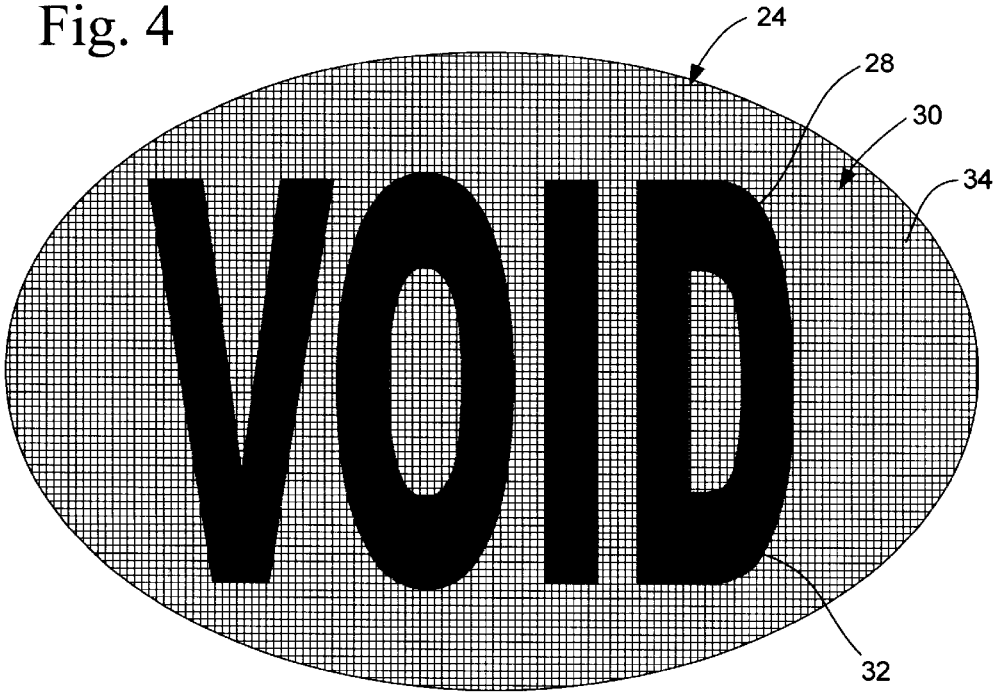
FIG. 4 is a top view of the FIG. 3 latent message appearing on the electronically copied document of FIG. 2, wherein the latent message is activated.

Referring to FIGS. 3 and 4, the latent message 24 comprises a foreground 28, which is formed by a nano-pattern 32, and a background 30, which is formed by a conventional pattern 34. The nano-pattern 32 and conventional pattern 34 are designed, such that the foreground 28 and background 30 of the latent message 24 exhibit substantially similar visual densities on the original document 20 (FIG. 3), but exhibit substantially different visual densities on the copied document 20' (FIG. 4). It should be noted that in the embodiment illustrated in FIGS. 3 and 4, the foreground 28 exhibits a visual density that is greater than that of the background 30 on the copied document 20'. As will be discussed in further detail below, a latent message can include a foreground and a background, wherein the background exhibits a visual density that is greater than that of the foreground on the copied document 20'.

In the preferred embodiment, visual density similarity between the nano-pattern 32 and conventional pattern 34 on the original document 20 is effected by printing both patterns using dots, lines, or other suitable element markings. The line resolution value (i.e., number of lines per inch), tonal screen value (i.e., percentage of ink coverage), and element size used to form the nano-pattern 32 and conventional pattern 34 are adjusted, such that the respective patterns exhibit substantially similar visual densities on the original document 20. For example, the line resolution value, element size, and tonal screen values for each of the nano-pattern 32 and conventional pattern 34 can be printed to exhibit a visual 5% value. Preferably, to facilitate the contrast between the nano-pattern 32 and conventional pattern 34 on the copied document 20', the nano-pattern 32 has a relatively low line resolution value (e.g., 50LPI) and relatively large element size, whereas the conventional pattern 34 has a relatively high line resolution value (e.g., 133LPI) and relatively small element size. It should be noted, however, that the nano-pattern 32 and conventional pattern 34 can have similar line resolution values and element sizes without straying from the principles taught by the present invention.

The visual density disparity between the nano-pattern 32 and conventional pattern 34 exhibited on the copied document 20' is effected by the darkening of the nano-pattern 32 when copied. Specifically, the use of the nano-pattern 32 in the foreground 28 takes advantage of the fundamental limitations of optical scanning digital systems and toner or ink jet output devices, which cannot reproduce very minute, fine detailed nano-printing of certain rectilinear or curvilinear patterns. That is, the nano-pattern 32 is designed, such that ink or toner traps are formed within the nano-pattern 32. These ink or toner traps fill and darken when electronically ink jet or toner printed. As a result, the ink or toner traps cause the nano-pattern 32 to exhibit an increased visual density when the original document 20 is electronically copied.

Although the visual density of the nano-pattern 32 substantially increases on the copied document 20', the conventional pattern 34, on the other hand, is normally printed. That is, the conventional pattern 34 is designed, such that ink or toner traps are not formed within the conventional pattern 34. In this respect, the conventional pattern 34 is similar to typical patterns that are printed on original documents. As a result, the visual density of the conventional pattern 34 does not substantially increase on the copied document 20'. Thus, the nano-pattern 32 and conventional pattern 34 are designed, such that the respective patterns exhibit substantially different visual densities on the copied document 20'. The disparate visual densities exhibited by the respective nano-pattern 32 and conventional pattern 34, when electronically copied, cause the latent message 24 to visually appear on the copied document 20', as illustrated in FIG. 4.

For the purposes of this specification, the nano-pattern 32 and conventional pattern 34, and thus, the foreground 28 and background 30, exhibit substantially similar visual densities if a casual observer cannot readily recognize the latent message 24, and exhibit substantially different visual densities if the same casual observer can readily recognize the latent message 24.

"Referring now to FIGS. 5–14, the "V" of the latent message foreground 28 is shown magnified to particularly point out the activating features of the nano-pattern 32 that facilitate the darkening of the latent message 24 when electronically copied. Specifically, the nano-pattern 32 can be formed from any combination of rectilinear elements 38(1) (particularly shown in FIGS. 5, 9, 11, and 13) and/or curvilinear elements 38(2) (particularly shown in FIG. 7, 11, and 13) that are coordinated to form miniature ink or toner traps 40. In the embodiments shown in FIGS. 5, 7, 9, 11, and 13, these elements 38 are combined into a pattern of nano-structures 42 (shown as nano-structures 42(1)–(8) in FIGS. 5–14) that are designed such that traps 40 are formed within, around, and/or between adjacent nano-structure 42. To facilitate the formation of the ink or toner traps, the nano-structures 42 are preferably miniaturized, e.g., less than one and one-half points in size. These traps 40 fill in and darken, when electronically copied, thereby transforming the exemplary nano-patterns 32 illustrated in FIGS. 5, 7, 9, 11, and 13 respectively, into the darkened nano-patterns 32 illustrated in FIGS. 6, 8, 10, 12, and 14. In general, the more traps that a particular nano-structure 42 forms, the more efficient the nano-structure 42 is in activating the latent message 24 when electronically copied."

Figure 5:
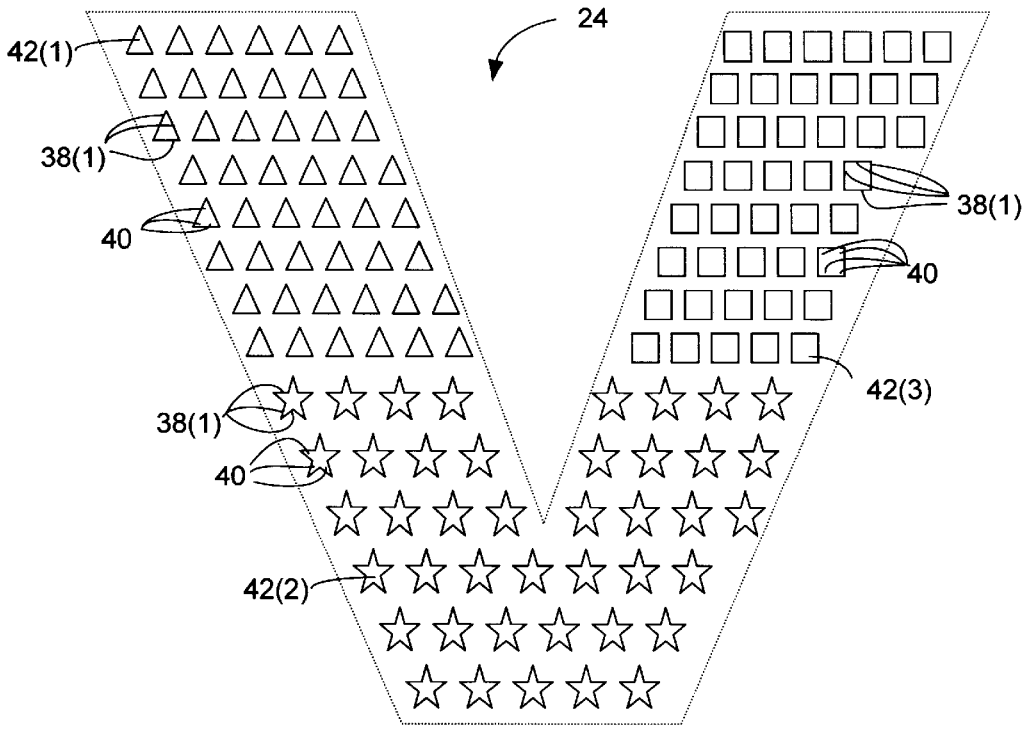
FIG. 5 is a magnified view of a preferred nano-pattern that can be used in a latent message, wherein the nano-pattern is inactivated.
Figure 6:
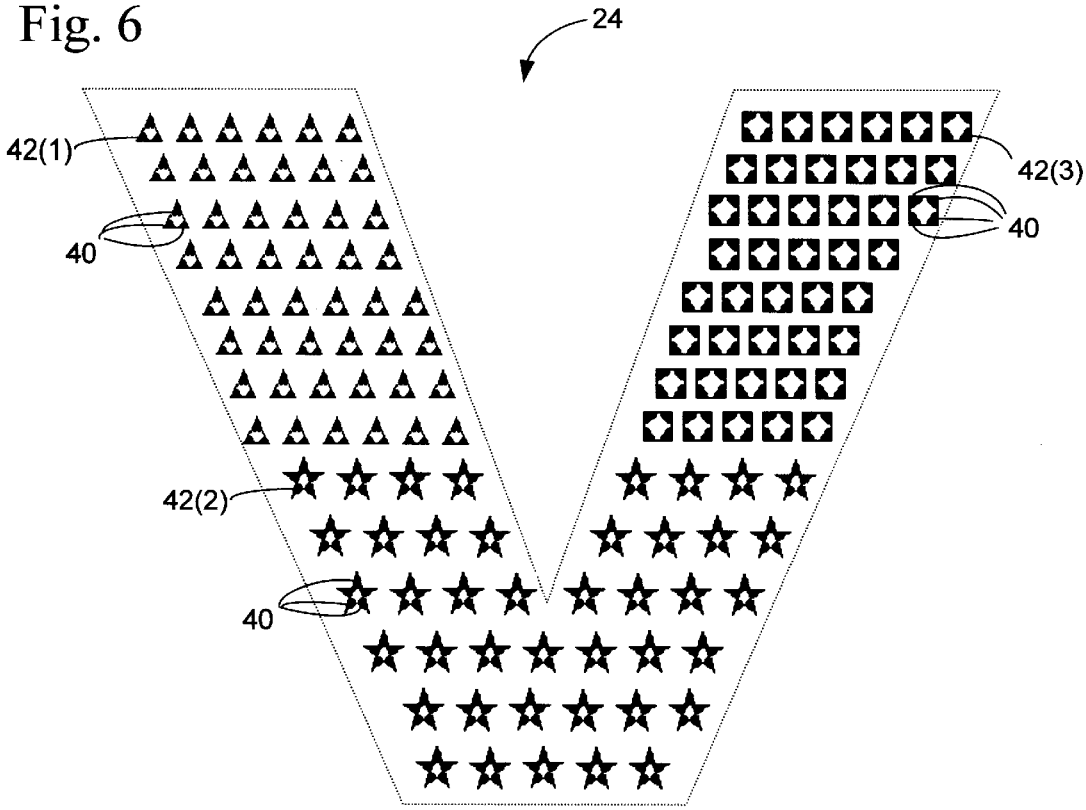
FIG. 6 is a magnified view of the electronically copied activated nano-pattern of FIG. 5.

Turning now to FIG. 5, the nano-structures 42 take the form of a series of polygons. Although the particular polygons used in the nano-pattern 32 can have uniform shapes, for purposes of illustration, a variety of different polygons, and specifically, triangles 42(1), stars 42(2), and squares 42(3), are shown in FIG. 5. Other polygons can be used, such as octagons, hexagons, pentagons, parallelograms, trapezoids, etc. As shown in FIG. 5, the traps 40 are formed at the intersection of the adjacent rectilinear elements 38(1). When electronically copied, these traps 40 fill in and darken, as illustrated in FIG. 6.

Figure 7:
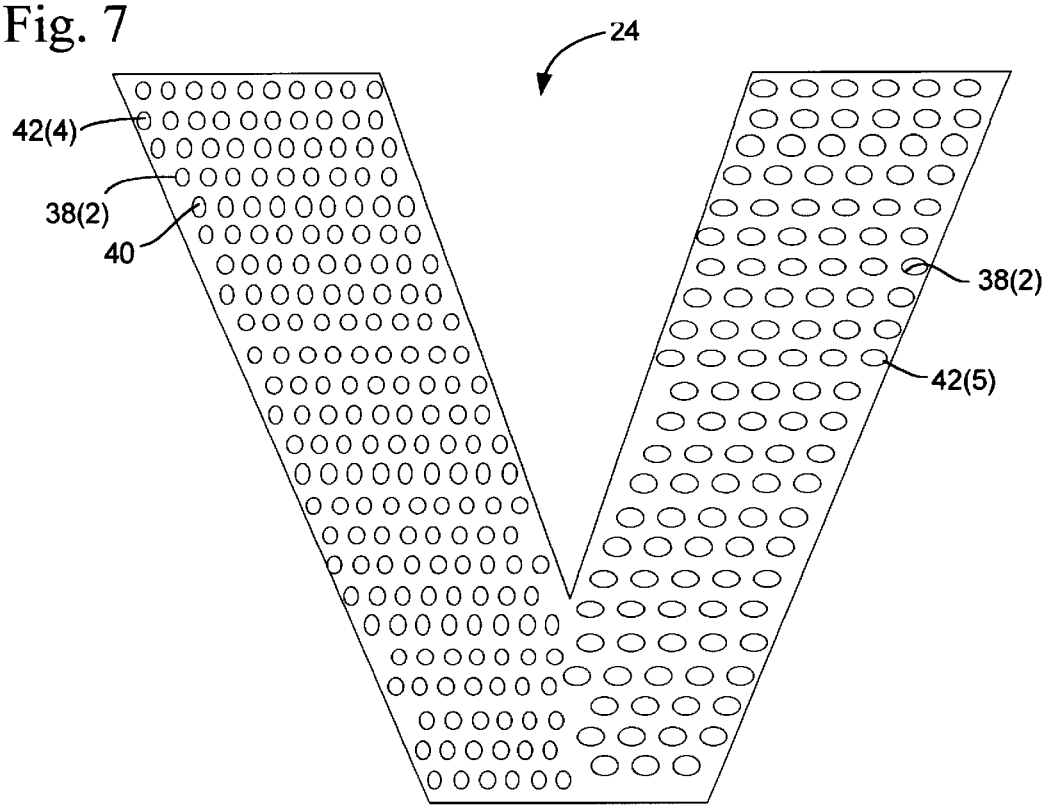
FIG. 7 is a magnified view of another preferred nano-pattern that can be used in a latent message, wherein the nano-pattern is inactivated.
Figure 8:
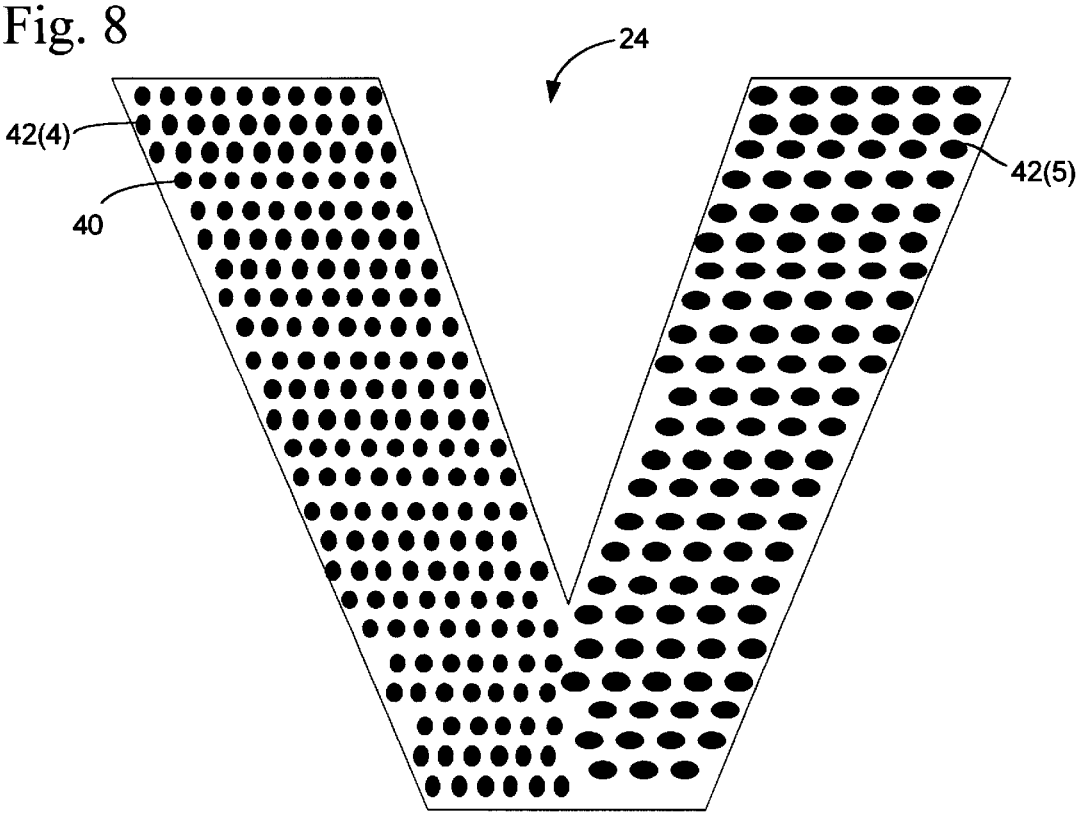
FIG. 8 is a magnified view of the electronically copied activated nano-pattern of FIG. 7.

Turning to FIG. 7, the nano-structures 42 take the form of a series of circles 42(4) or ovals 42(5), with the traps 40 formed within the centers of the curvilinear elements 38(2). When electronically copied, these traps 40 fill in and darken, as illustrated in FIG. 8.

The polygons, circles, and ovals illustrated in FIGS. 5 and 7 can be characterized as having a closed architecture, since the ink or toner traps are formed within these nano-structures 42. In contrast, the nano-structures 42 illustrated in FIG. 9 take the form of a series of crosses and x's 42(6), with traps (not shown) being formed around and between the rectilinear elements 38(1). Thus, these nano-structures 42 have an open architecture. When electronically copied, these traps 40 fill in and darken, as illustrated in FIG. 10.

Figure 11:
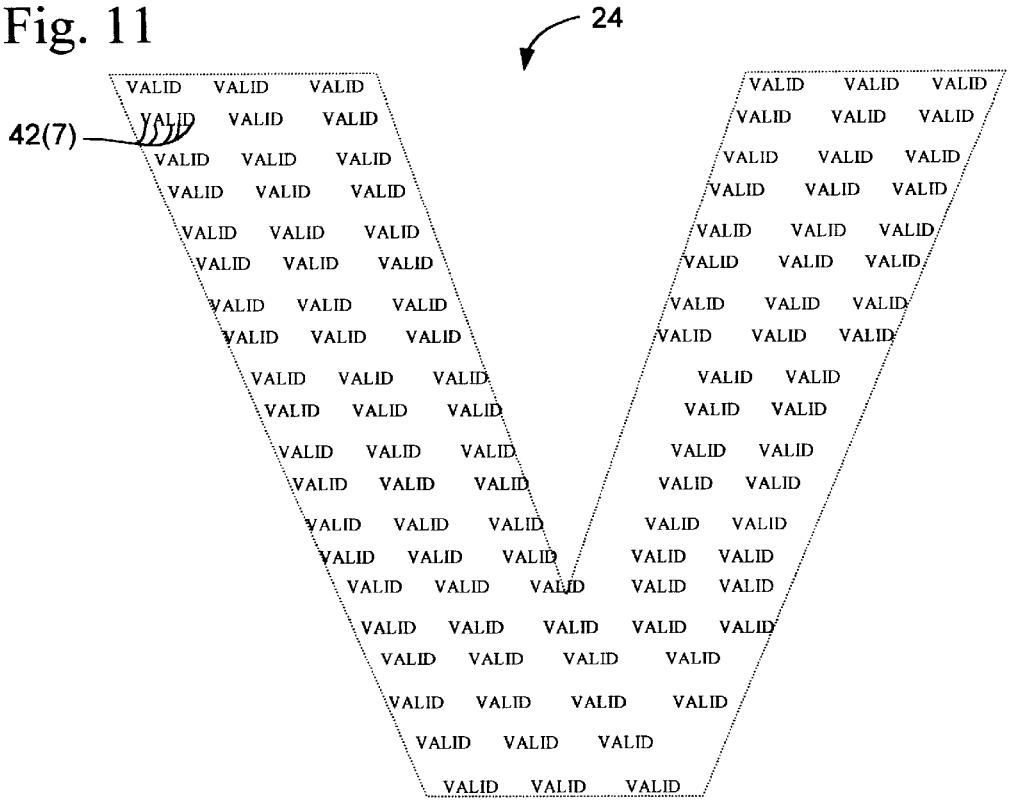
FIG. 11 is a magnified view of still another preferred nano-pattern that can be used in a latent message, wherein the nano-pattern is inactivated.
Figure 12:
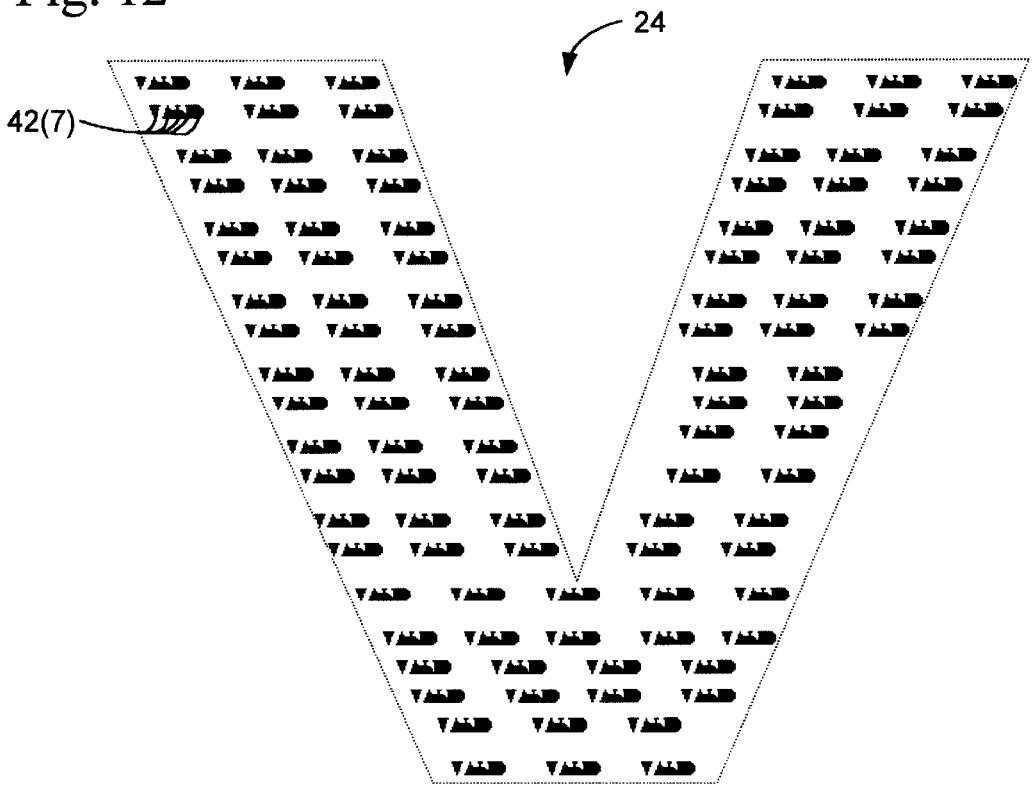
FIG. 12 is a magnified view of the electronically copied activated nano-pattern of FIG. 11.
Figure 13:
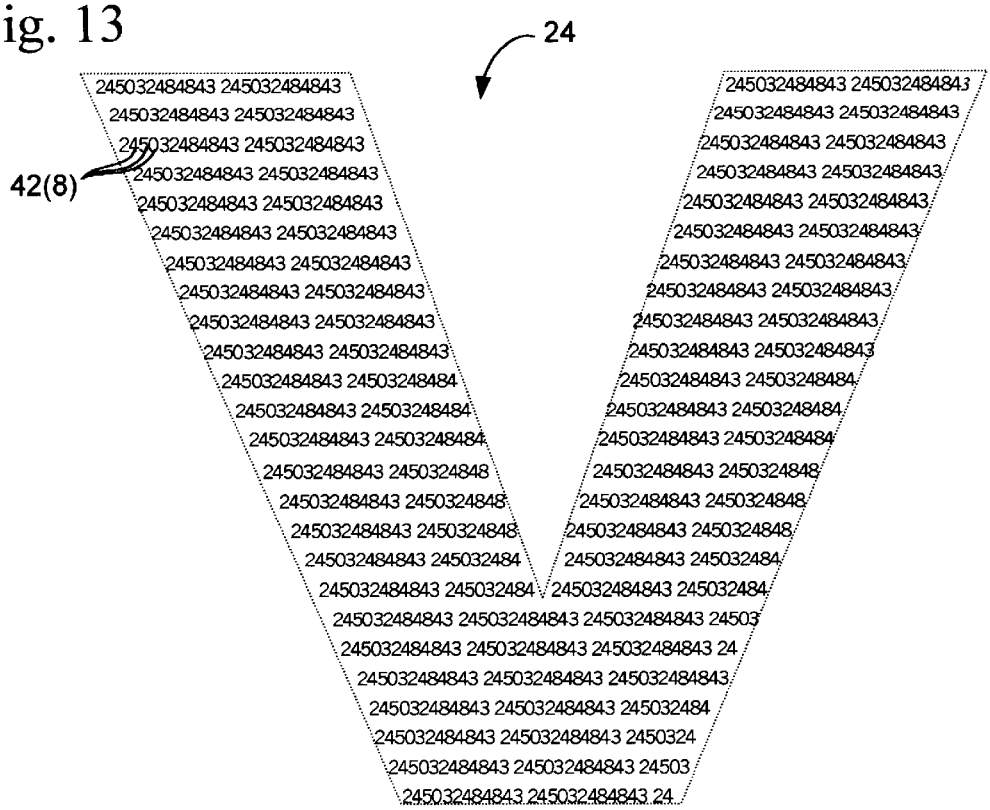
FIG. 13 is a magnified view of still another preferred nano-pattern that can be used in a latent message, wherein the nano-pattern is inactivated.
Figure 14:
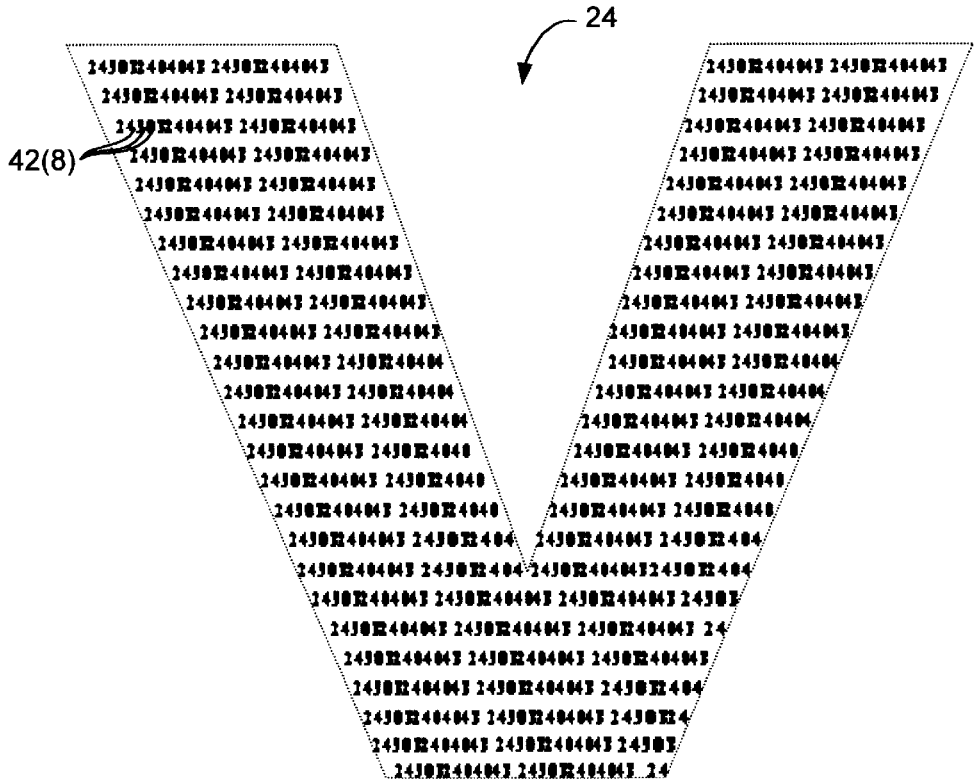
FIG. 14 is a magnified view of the electronically copied activated nano-pattern of FIG. 13.

Turning now to FIGS. 11 and 13, the nano-structures 42 take the form of a series of alpha-numerical characters 42(7) and 42(8), respectively, and in this case, the repeating word "VALID" or the repeating number "245032484843". As can be seen, the traps (not shown) are formed within, around, and between certain alpha-numerical characters 42(7) and 42(8), which, when electronically copied, fill in and darken, as illustrated in FIGS. 12 and 14. In this case, these nano-structures 42 either have an open architecture, close architecture, or both. It should be noted that the series of alpha-numerical characters 42(7) are not to be limited to the formation of words or numbers, but can, e.g., comprise a repeating pattern of regular or irregular size and spaced individual characters or characters combined with other nano-structures that are particularly suited for forming ink or toner traps.

It should be noted that the present inventions should not be limited to the use of discrete characters, such as polygons, circles, crosses or x's, or alpha-numerical characters, to form the nano-pattern 32. Rather, the nano-pattern 32 can be formed from any combination of elements, whether they be rectilinear or curvilinear, or regular or irregular, that are coordinated to form ink or toner traps. For example, a continuous nano-pattern designed to form ink or toner traps can be used.

It should also be noted that the nano-pattern can either be regular or irregular. For the purposes of the specification, a regular nano-pattern is one composed of a series of nano-structures 42 that are substantially uniformly sized and or spaced from one another, such as those illustrated in FIGS. 5 and 7. In contrast, an irregular nano-pattern is one composed of a series of nano-structures 42 that are substantially variably sized and/or spaced from one another, such as those illustrated in FIGS. 9 and 11.

For example, as illustrated in FIG. 11, there is a relatively small amount of space in between the individual characters 42(7) of the word "VALID," whereas there is a relatively great amount of space in between the words themselves. As a result, formation of the traps between the individual characters 42(7) is facilitated, without the foreground of the latent message 24 exhibiting too great of a visual density. That is, although the close spacing between the individual characters 42(7) increases the visual density with respect to each individual word, this increase in visual density is compensated by increasing the spacing between the words to lessen the overall visual density of the foreground of the latent message 24. Although this irregular nano-pattern has been illustrated with respect to alpha-numerical characters, irregular nano-patterns can be formed with other nano-structure shapes, such as polygons, crosses or x's.

Figure 9:
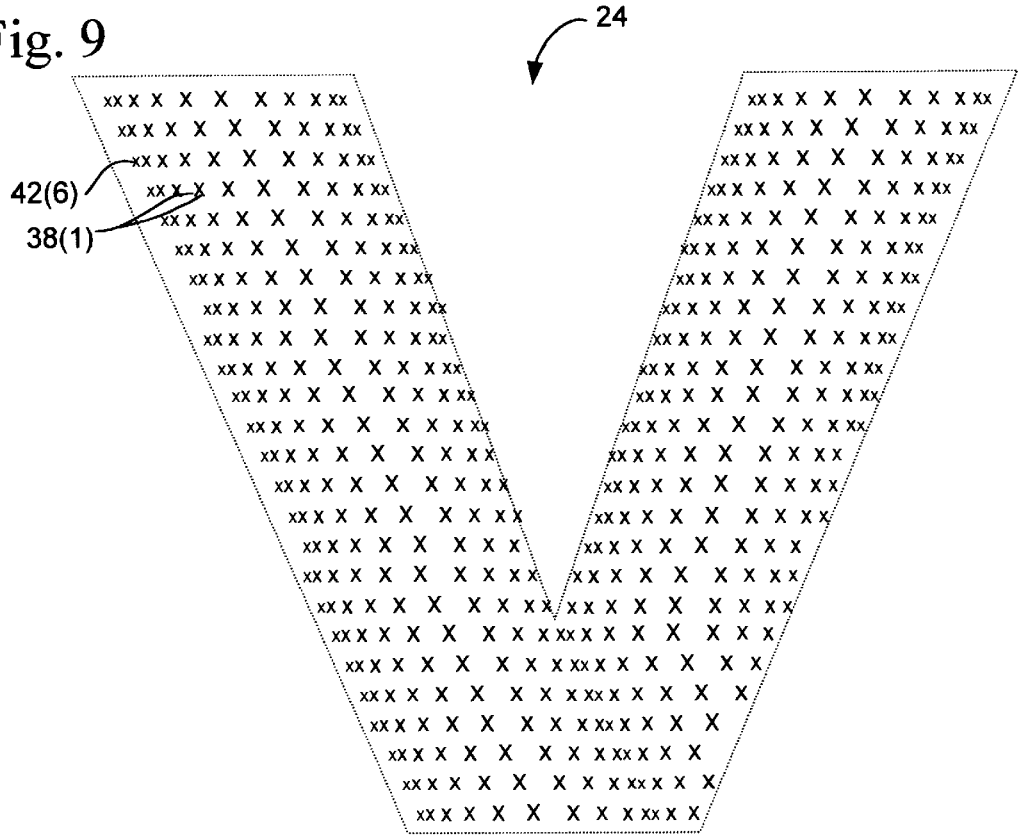
FIG. 9 is a magnified view of still another preferred nano-pattern that can be used in a latent message, wherein the nano-pattern is inactivated.
Figure 10:
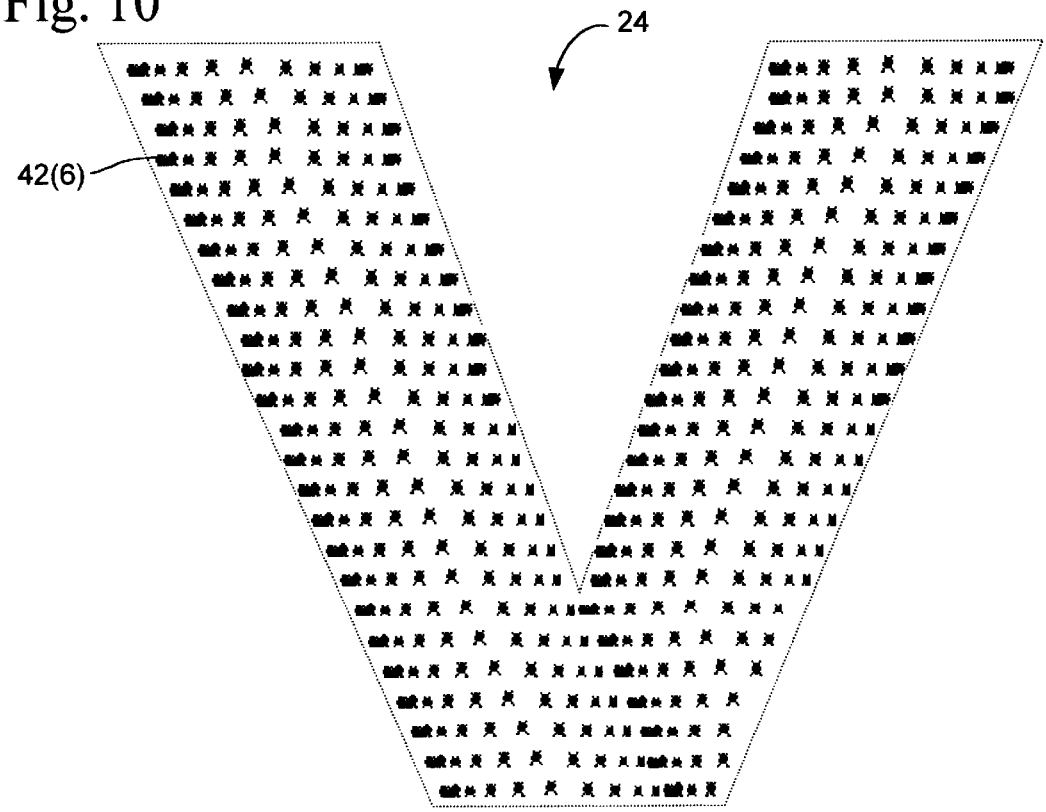
FIG. 10 is a magnified view of the electronically copied activated nano-pattern of FIG. 9.

As illustrated in FIG. 9, the irregularity of the nano-pattern is modulated, meaning that there is a gradual change in shape, angle, size, and/or spacing between adjacent nano-structures 42. Thus, in this case, the spacings between adjacent x's 42(6) gradually increase and decrease. Likewise, the size of adjacent x's 42(6) gradually increase and decrease.

It is anticipated that further levels of security can be provided by the nano-pattern 32 besides the formation of the latent message 24. For example, using alpha-numerical characters 42(7) in the nano-pattern 32 has the added advantage of conveying information to the observer of the original document 20. That is, the printer of the original document 20 can nano-print the latent message 24 in the form of numbers or words, in effect, embodying a separate message, such as the indicia indicting validity, date printed, customer's name, and/or secret numerical code, within the latent message 24.

In the embodiment illustrated in FIG. 11, an observer in possession of the original document 20, knowing that the original document 20 comprises the repeating words "VALID" in nano-printing, can review the original document 20 with a magnification aid, such as a magnification loupe. If the repeating word "VALID" appears in the nano-pattern 32 on the original document 20, its authenticity is ensured. In contrast, if the repeating word "VALID" has been obliterated (shown in FIG. 12), which will typically occur during the electronic copying process, an observer in possession of the copied document 20' will know that he or she is in possession of the copied document 20'.

In the embodiment illustrated in FIG. 13, the nano-number "245032484843" may represent a secret code known only by an authorized person. For example, the number may be an algorism, the nano-digits of which add up to "47". Optionally, certain portions of the latent message 24, e.g., the "I" and "D", may contain nano-numbers that represent meaningless data to further confound the unscrupulous copyist. Furthermore, one or more of the nano-digits in any one of the letters composed in the latent message 24, i.e., "V", "O", "I", or "D", can be minutely deviated, such that an authorized person, knowing that a deviated nano-digit exists, and knowing the location, design, and extent of the deviation, can authenticate the original document 20. In contrast, an unscrupulous copyist would not notice the deviated nano-digit within the generally uniform pattern of all the other nano-digits, making it difficult to exactly reproduce the deviated nano-digit by traditional printing methods. For example, as illustrated in FIG. 13, the nano-digit "3" in the right upperhand corner of the "V" is printed in a different font than the other nano-digits. Without knowledge of this deviated nano-digit, one would not recognize it within the context of the uniform styled digits. Such deviations should not be limited to nano-digits or font changes, but can be incorporated with any nano-structure using any deviation that could be noticed by a knowing individual, but would not be noticed by an unsuspecting individual.

The algorism need not be based on an "add" function, but may be based on other functions, the application of which to the number formulation produces a known numerical answer. Thus, an authorized person in possession of the original document 20, knowing the specific formulation of the repeating nano-numbers that appear in the nano-pattern 32 on the original document 20, can review the original document 20 with the magnification aid. If the nano-digits of the repeating nano-number add up to "47", its authenticity is ensured. In contrast, if the repeating nano-number has been obliterated (shown in FIG. 14), which will typically occur during the electronic copying process, an observer in possession of the copied document 20' will know that he or she is in possession of the copied document 20'.

Furthermore, the nano-pattern 32 has the potential to carry machine readable data for spectral analysis. This data can be evaluated by performing an optical correlation of the reflection spectrum of the document to be validated with the original document. Thus, other levels of security are provided on top of that provided by the appearance of the latent message 24, itself.

Figure 15:
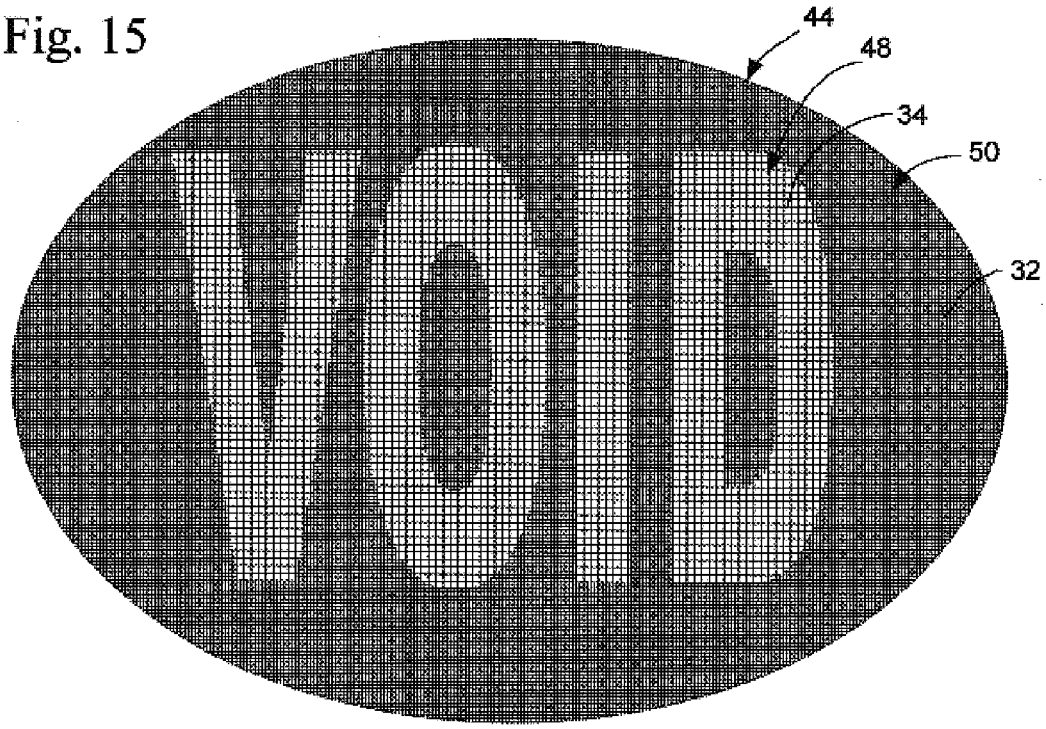
FIG. 15 is a top view of alternative preferred latent message appearing on the original document of FIG. 1, wherein the latent message is inactivated.
Figure 16:
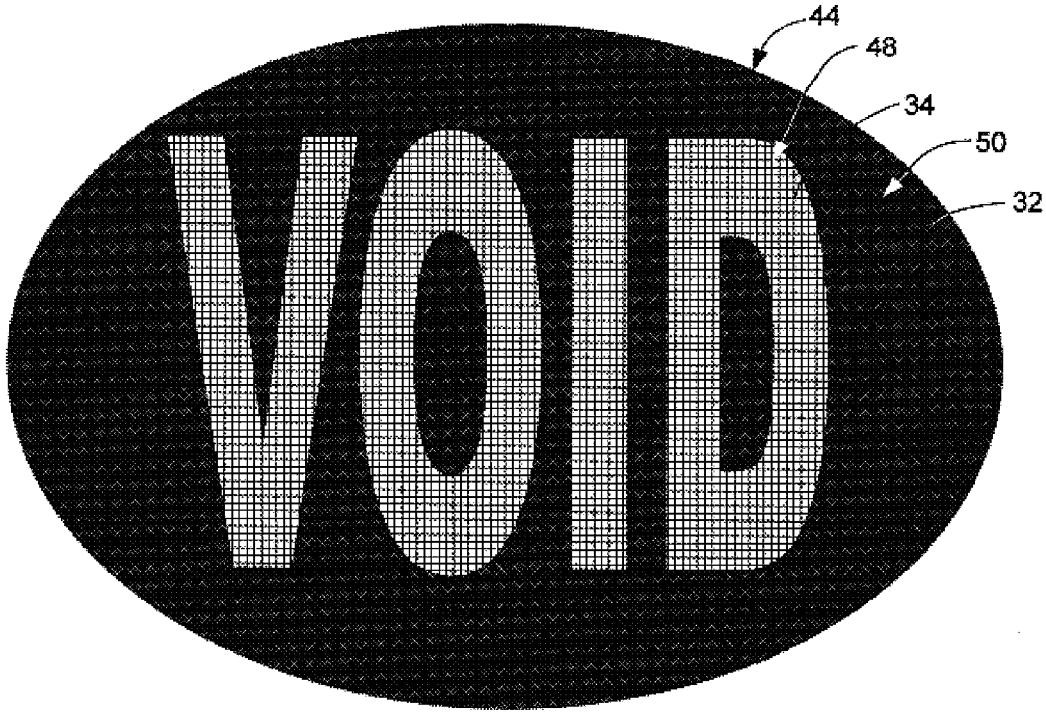
FIG. 16 is a top view of the FIG. 15 latent message appearing on the electronically copied document of FIG. 2, wherein the latent message is activated.

Although the latent message 24 illustrated in FIGS. 3 and 4 is produced by designing the nano-pattern 32 and conventional pattern 34, such that the foreground 28 exhibits a visual density that is greater than that of the background 30 on the copied document 20', a latent message can be produced by reversing the nano-pattern 32 and conventional pattern 34. Specifically, FIGS. 15 and 16 illustrate a latent message 44 that comprises a foreground 48, which is formed by the conventional pattern 34, and a background 50, which is formed by the nano-pattern 32. Thus, like the latent message 24 illustrated in FIGS. 3 and 4 above, the foreground 48 and background 50 of the latent message 44 exhibit similar visual densities on an original of a document (FIG. 15), but differing visual densities on a copy of a document (FIG. 16). Unlike the latent message 24 illustrated in FIGS. 3 and 4 above, however, the background 50 exhibits a visual density that is greater than that of the foreground 48 on the copied document 20', rather than the other way around.

Figure 17:
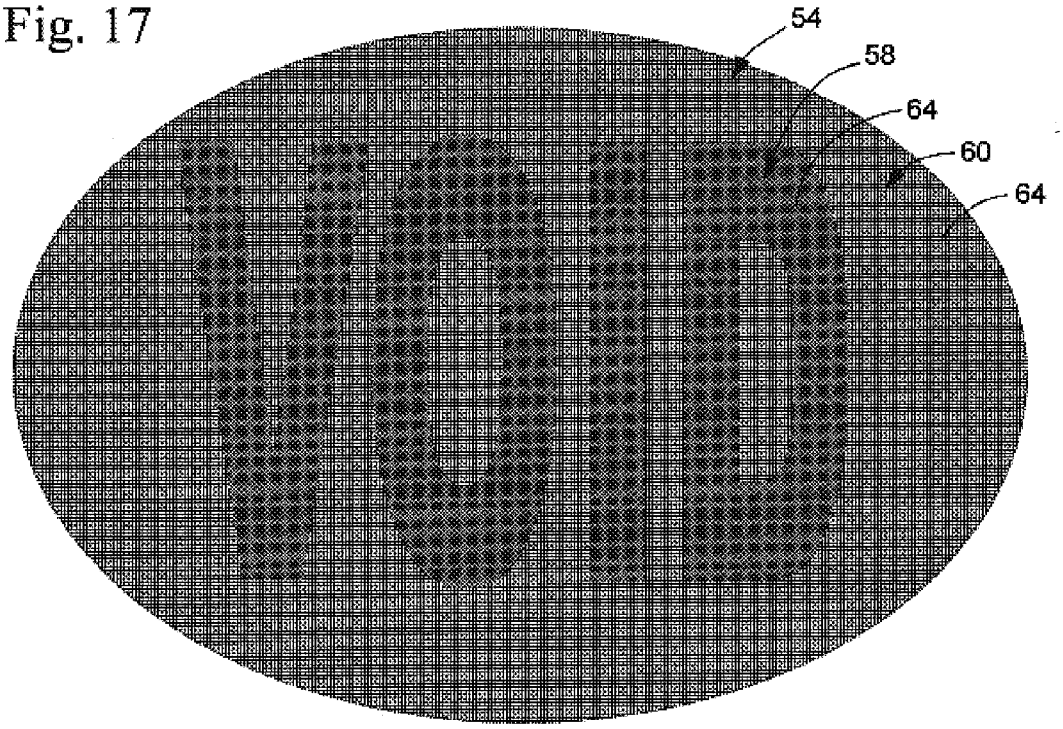
FIG. 17 is a top view of another alternative preferred latent message appearing on the original document of FIG. 1, wherein the latent message is inactivated.
Figure 18:
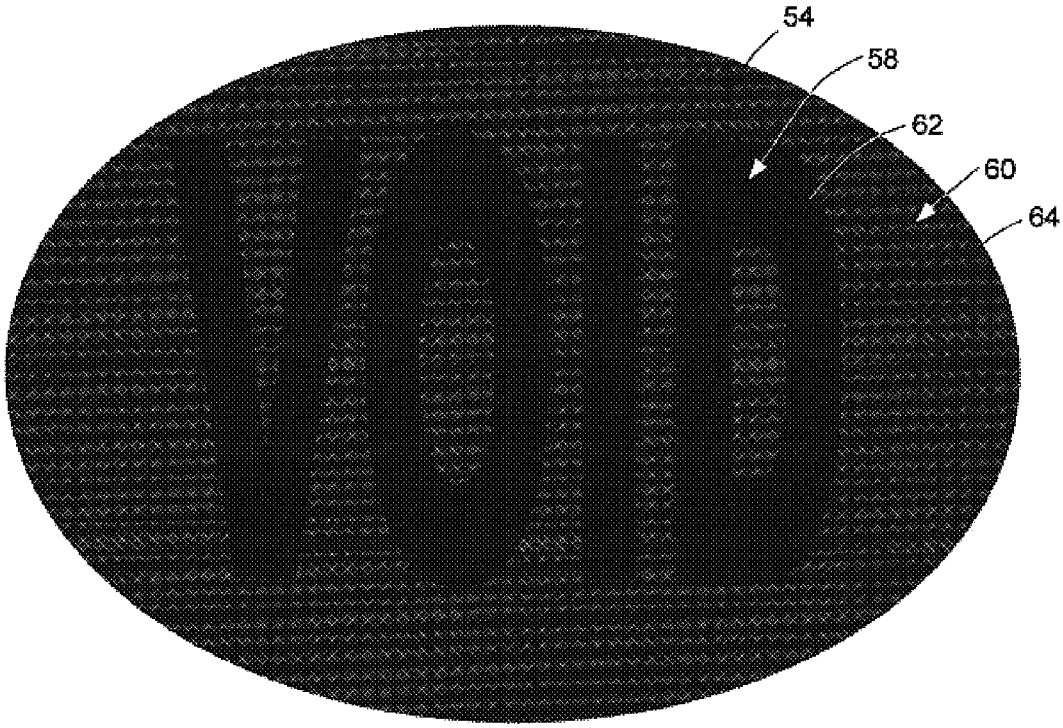
FIG. 18 is a top view of the FIG. 17 latent message appearing on the electronically copied document of FIG. 2, wherein the latent message is activated.

Although the above-described latent messages 24 and 44 are formed by incorporating a nano-pattern into one of the foreground and background, and a conventional pattern into the other of the foreground and background, a latent message can be formed by using two nano-patterns. Specifically, FIGS. 17 and 18 illustrate a latent message 54 that comprises a foreground 58, which is formed by a first nano-pattern 62, and a background 60, which is formed by a second nano-pattern 64 that is different from the first nano-pattern 62. Like the latent message 24 illustrated in FIGS. 3 and 4 above, the foreground 58 and background 60 of the latent message 54 exhibit similar visual densities on an original of the document (FIG. 17), but differing visual densities on a copy of the document (FIG. 18).

Like the latent message 44, the visual density similarity between the respective first and second nano-patterns 62 and 64 exhibited on the original document 20 is effected by printing both patterns using dots, lines, or other suitable element markings, and accordingly adjusting their element size, line resolution, and tonal screen values. Visual density disparity between the respective first and second nano-patterns 62 and 64 exhibited on the copied document 20' is effected by the darkening of the first nano-pattern 62 with respect to the second nano-pattern 64 when copied. That is, the respective first and second nano-patterns 62 and 64 are designed, such that ink or toner traps are formed within both patterns. The ink or toner traps formed in the first nano-pattern 62, however, are more pronounced than those formed in the second nano-pattern 64. Preferably, the second nano-pattern 64 does not form any ink or toner traps. As a result, the first nano-pattern 62 exhibits an increased visual density with respect to the second nano-pattern 64, when the original document 20 is electronically copied.

Although the latent message 54 illustrated in FIGS. 17 and 18 is produced by designing the first and second nano-patterns 62 and 64, such that the foreground 58 exhibits a visual density that is greater than that of the background 60 on the copied document 20', a latent message can be produced by reversing the first and second nano-patterns 62 and 64. That is, the foreground 58 and background 60 can be respectively formed by the second nano-pattern 64 and first nano-pattern 62, such that the background 60 exhibits a visual density that is greater than that of the foreground 58 on the copied document 20'.

Figure 19:
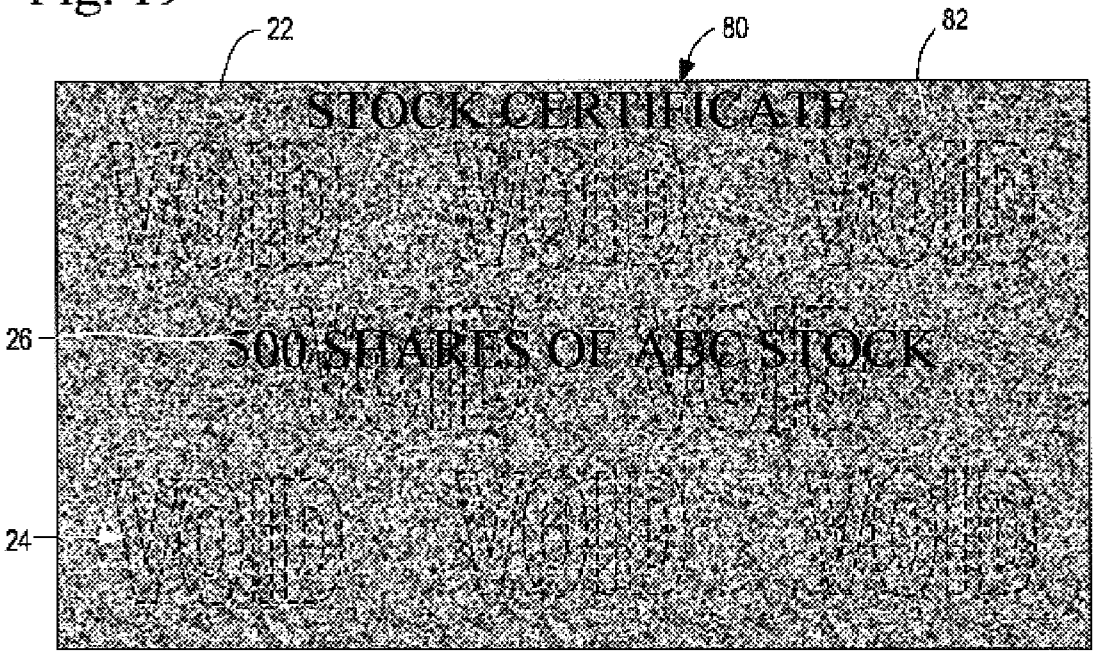
FIG. 19 is a top view of an original counterfeit-resistant document constructed in accordance with another preferred embodiment of the present inventions.

FIG. 19 depicts a counterfeit-resistant original document 80, which is similar to the counterfeit-resistant original document 20 described above in FIG. 1, with the exception that the original document 80 comprises an additional camouflage pattern 82, which further obscures or conceals the latent message 24 on the original document 80. To the extent that features of the original documents 20 and 80 are similar, identical reference numbers have been assigned.

The camouflage pattern 82 may be composed of any suitable ink that facilitates the camouflaging of the latent message 24, e.g., a standard ink or a dynamically changing ink (i.e., an ink the color and density of which changes with an environmental condition). If a standard ink is used, the visual density of the ink is preferably great enough to conceal the latent message 24. In the case where the camouflage pattern 82 is composed of a standard ink, the latent message 24, i.e., the nano-pattern and conventional pattern, is also composed of a standard ink, thereby allowing the camouflage pattern 82 and latent message to be printed at one time. Of course, the camouflage pattern 82 can also be printed over the latent message 24 in a less dense environmental changing ink such as described in co-pending applications Ser. No. 09/046/571 to provide a camouflaging effect.

If a dynamically changing ink, such as a thermochromic ink (i.e., an ink the color and density of which changes with temperature), is used for the camouflage pattern 82, its chemical composition is selected, such that the camouflage pattern 82 darkens as the temperature decreases, and lightens as the temperature increases. Thus, the visual density of the thermochromic ink is inversely proportional to the temperature to which the ink is exposed.

Figure 20:
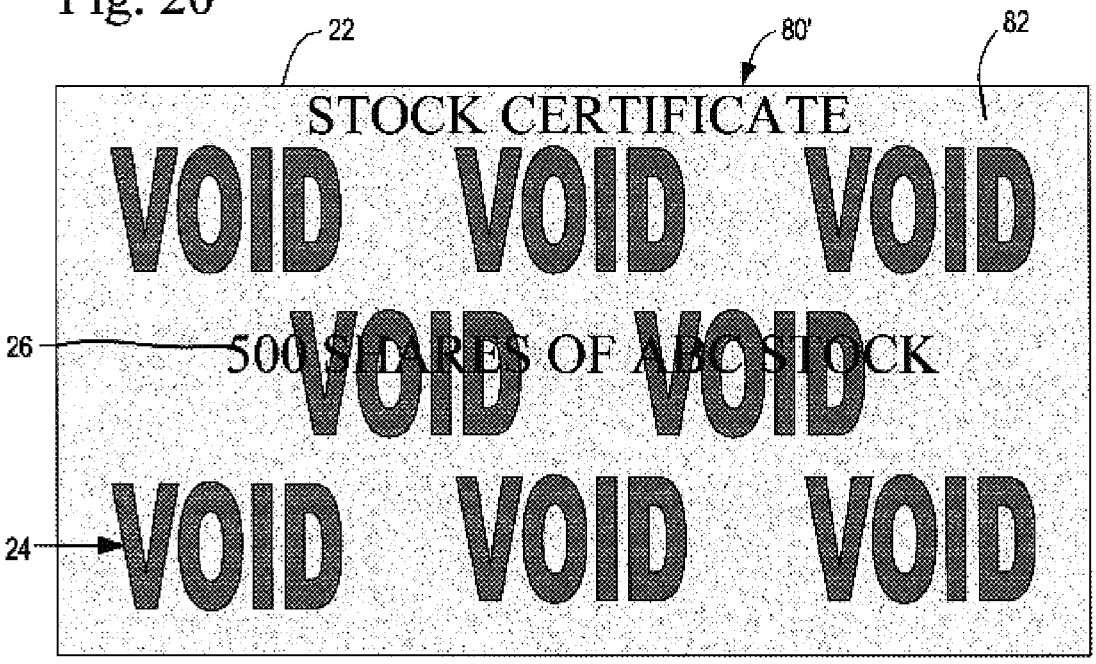
FIG. 20 is a top view of an electronic copy of the document of FIG. 19.

Because the visual density of the thermochromic ink is inversely proportional to temperature levels, the thermochromic ink has an inactivated state when exposed to a low-temperature range (e.g., at or below room temperature), and has an activated state when exposed to a high-temperature range (e.g., the temperature to which typical copying devices subject the document). As a result, the color density of the camouflage pattern 82 is darker during normal temperature viewing conditions, thus facilitating the suppression of the latent message 24 on the original document 80. In this manner, the latent message 24 does not visually appear to a casual observer of the original document 80 (FIG. 19). In contrast, the color of the camouflage pattern 82 lightens at scanning temperatures, thus becoming less dense and facilitating the exhibition of the latent message 24 on a copied document 80' (FIG. 20). In this manner, the latent message 24 visually appears to the casual observer of the copied document 80'.

To facilitate this effect, the thermochromic ink used to make the camouflage pattern 82 has a cold visual density level (i.e., a visual density level measured at 60° F. or below) between 0.15 and 0.80, and a warm visual density level (i.e., a visual density level measured at 76° or above) between 0.02 and 0.22, as measured with a GREYTAG D19C densitometer, are preferably employed. The presently most preferred thermochromic inks, however, are those that have a cold visual density level between 0.15 and 0.35 and a warm visual density level between 0.08 and 0.22. The exact composition of thermochromic ink is preferably modified to effect the exact visual density changing properties of the thermochromic ink. Ultimately, selection of a preferred thermochromic ink depends on the exact temperatures to which the ink will be exposed and the opaqueness and color hue pigmentation of the ink.

Whether the camouflage pattern 82 is composed of a standard ink or environmentally changing ink, the particular graphics employed in the camouflage pattern 82 plays a significant role in camouflaging the latent message 24. In general, the graphics pattern of the camouflage pattern is preferably formed with a certain level of irregularity to facilitate camouflaging of the latent message 24. The more irregular patterns with a greater diversity of tones or alternating solid/open areas are the easiest to print and camouflage, but lose some effectiveness when digitally copied. On the other hand, the smoother, adjacent patterns are more difficult to print without noticing hidden indicia, but are much more effective when digitally copied.

Further details on the manufacture of documents that utilize camouflage patterns to conceal or obscure latent messages are disclosed in U.S. Pat. No. 5,873,604, and copending application Ser. No. 09/046,571, both of which have previously been incorporated herein by reference.

While embodiments and applications of this invention have been shown and described, it would be apparent, to the readers of this description, that many more modifications are possible without departing from the inventive concepts described herein. The invention, therefore, is not to be restricted beyond the scope and in the spirit of the appended claims.

What is claimed:

1. A document, comprising:

a substrate; and a nano-pattern associated with said substrate, wherein said nano-pattern comprises printed portions and one or more traps confined between said printed portions that fill in on a copy of said document with printing matter, when electronically copied, to form a latent message that appears on said copy of said document.

2. The document of claim 1, wherein said nano-pattern forms a foreground of said latent message.

3. The document of claim 1, wherein said nano-pattern forms a background of said latent message.

4. The document of claim 1, wherein said nano-pattern forms one of a foreground and a background of said latent message, and said nano-pattern is configured, such that said one of a foreground and a background of said latent message exhibits a first visual density on an original of said document, and a second visual density greater than the first visual density on said copy of said document.

5. The document of claim 1, further comprising another pattern, wherein said nano-pattern forms one of a foreground and a background of said latent message, and said other pattern forms another of said foreground and said background of said latent message.

6. The document of claim 1, wherein said latent message is a warning or alert message.

7. The document of claim 1, further comprising bearer information associated with said substrate.

8. The document of claim 1, wherein said nano-pattern comprises less than two-point print.

9. The document of claim 1, wherein said nano-pattern comprises less than one and one-half point print.

10. The document of claim 1, wherein said nano-pattern is regular.

11. The document of claim 1, wherein said nano-pattern is irregular.

12. The document of claim 1, wherein said nano-pattern is modulated.

13. The document of claim 5, wherein said at least one of said nano-pattern and said other pattern is printed in half-tone.

14. The document of claim 5, wherein said nano-pattern and said other pattern are configured, such that said foreground and said background exhibit substantially similar visual densities on an original of said document, and exhibit substantially different visual densities on a copy of said document.

15. The document of claim 5, wherein said other pattern is another nano-pattern that comprises one or more traps that fill in with printing matter, when electronically copied, to form said latent message.

16. A document, comprising:

a substrate; and a latent message formed by a pattern associated with said substrate, wherein said pattern is configured for trapping printing matter between printed portions of said pattern on a copy of said document, when electronically copied, to activate said latent message on said copy of said document.

17. The document of claim 16, wherein said pattern forms a foreground of said latent message.

18. The document of claim 16, wherein said pattern forms a background of said latent message.

19. The document of claim 16, wherein said pattern is configured for exhibiting a first visual density on an original of said document, and exhibiting a second visual density greater than said first visual density on said copy of said document.

20. The document of claim 16, wherein said pattern forms one of a foreground and a background of said latent message, and another pattern forms the other of said foreground and said background of said latent message.

21. The document of claim 16, wherein said latent message is a warning or alert message.

22. The document of claim 16, further comprising bearer information associated with said substrate.

23. The document of claim 16, wherein said printing matter comprises ink.

24. The document of claim 16, wherein said printing matter comprises toner.

25. The document of claim 16, wherein said substrate comprises paper stock.

26. The document of claim 20, wherein said pattern and said other pattern are configured for respectively exhibiting first and second visual densities on an original of said document, and respectively exhibiting third and fourth visual densities on said copy of said document, wherein said first and second visual densities are substantially similar, and said third and fourth visual densities are substantially different.

27. A document, comprising:

a substrate;

a nano-pattern associated with said substrate, wherein said nano-pattern comprises printed portions and one or more traps confined between said printed portions that fill in on a copy of said document with printing matter, when electronically copied, to form a latent message that appears on said copy of said document; and a camouflage pattern associated with said substrate, wherein said camouflage pattern coincides with said latent message.

28. The document of claim 27, wherein said camouflage pattern and said nano-pattern are composed of a standard ink.

29. The document of claim 27, wherein said camouflage pattern is composed of an environmentally changing ink.

30. The document of claim 29, wherein said environmentally changing ink comprises a thermochromic ink.

31. The document of claim 30, wherein said thermochromic ink has a cold visual density level of between 0.15 and 0.80 and a warm visual density level of between 0.02 and 0.22.

32. The document of claim 30, wherein said thermochromic ink has a cold visual density level of between 0.15 and 0.35 and a warm visual density level of between 0.08 and 0.22.

33. The document of claim 30, wherein said thermochromic ink has a visual density that inversely varies with temperature.

34. The document of claim 30, wherein said thermochromic ink has a cold density, such that said camouflage pattern is inactivated at room temperatures, and a warm density, such that said camouflage pattern is activated at scanning temperatures.

35. The document of claim 30, wherein the camouflage pattern exhibits a first visual density at room temperatures to suppress said latent message on an original of said document, and exhibits a second visual density at scanning temperatures to exhibit said latent message on said copy of said document.

36. A document, comprising:

a substrate; and a plurality of nano-structures associated with said substrate, each of said plurality of nano-structures being configured for at least partially filling in with printing matter on a copy of said document, when electronically copied, such that said plurality of nano-structures forms a latent message that appears on said copy of said document.

37. The document of claim 36, wherein said plurality of nano-structures forms a foreground of said, latent message.

38. The document of claim 36, wherein said plurality of nano-structures forms a background of said latent message.

39. The document of claim 36, wherein said plurality of nano-structures forms one of a foreground and a background of said latent message, and said plurality of nano-structures is configured, such that said one of a foreground and a background of said latent message exhibits a first visual density on an original of said document, and a second visual density greater than the first visual density on said copy of said document.

40. The document of claim 36, wherein said latent message is a warning or alert message.

41. The document of claim 36, further comprising bearer information associated with said substrate.

42. The document of claim 36, wherein each of said plurality of nano-structures is equal to or less than one and one-half point print.

43. The document of claim 36, wherein said plurality of nano-structures comprises a plurality of polygons.

44. The document of claim 36, wherein said plurality 6f nano-structures comprises a plurality of alpha-numerical characters.

45. The document of claim 36, wherein said plurality of alpha-numerical characters forms a series of words.

46. The document of claim 36, wherein said plurality of alpha-numerical characters forms an algorism.

47. The document of claim 36, wherein said plurality of nano-structures comprises a plurality of ovals or circles.

48. The document of claim 36, wherein said plurality of nano-structures comprises a plurality of crosses or x's.

49. The document of claim 36, wherein said plurality of nano-structures exhibits an open architecture.

50. The document of claim 36, wherein said plurality of nano-structures exhibits a closed architecture.

51. The document of claim 36, wherein one or more of said plurality of nano-structures is deviated.

52. A document, comprising:

a substrate; and a pattern associated with said substrate, said pattern comprising a plurality of elements configured for trapping printing matter between adjacent elements or within elements on a copy of said document, when electronically copied, to form a latent message that appears on said copy of said document.

53. The document of claim 52, wherein said pattern forms a foreground of said latent message.

54. The document of claim 52, wherein said pattern forms a background of said latent message.

55. The document of claim 52, wherein said pattern forms one of a foreground and a background of said latent message, and said pattern is configured, such that said one of a foreground and a background of said latent message exhibits a first visual density on an original of said document, and a second visual density greater than the first visual density on said copy of said document.

56. The document of claim 52, wherein said latent message is a warning or alert message.

57. The document of claim 52, further comprising bearer information associated with said substrate.

58. The document of claim 52, wherein each of said one or more elements is rectilinear.

59. The document of claim 52, wherein each of said one or more elements is curvilinear.

60. A document, comprising:

a substrate; and a pattern associated with said substrate, said pattern composed of a non-dynamically changing ink and comprising one or more traps configured for filling in on a copy of said document with printing matter, when electronically copied, to form a latent message that appears on said copy of said document.

61. The document of claim 60, wherein said pattern forms a foreground of said latent message.

62. The document of claim 60, wherein said pattern forms a background of said latent message.

63. The document of claim 60, wherein said pattern forms one of a foreground and a background of said latent message, and said pattern is configured, such that said one of a foreground and a background of said latent message exhibits a first visual density on an original of said document, and a second visual density greater than the first visual density on said copy of said document.

64. The document of claim 60, wherein said latent message is a warning or alert message.

65. The document of claim 60, further comprising bearer information associated with said substrate.

* * * * *